US007381112B1

(12) United States Patent
Symes

(10) Patent No.: US 7,381,112 B1
(45) Date of Patent: Jun. 3, 2008

(54) AIR-DRIVEN NOVELTY ITEM

(76) Inventor: Greg L. Symes, 1634 Jolly Cir., Taylorsville, UT (US) 84123

( * ) Notice: Subject to any disclaimer, the term of this patent is extended or adjusted under 35 U.S.C. 154(b) by 493 days.

(21) Appl. No.: 10/934,569

(22) Filed: Sep. 3, 2004

Related U.S. Application Data

(60) Provisional application No. 60/500,752, filed on Sep. 5, 2003.

(51) Int. Cl.
*A63H 29/10* (2006.01)

(52) U.S. Cl. ..... 446/176; 446/179; 446/129; 40/426; 40/410; 40/412

(58) Field of Classification Search ..... 446/176, 446/129, 179; 40/412, 426, 410
See application file for complete search history.

(56) References Cited

U.S. PATENT DOCUMENTS 3,964,190 A * 6/1976 Leo ..... 40/412
5,533,272 A * 7/1996 Bagwell ..... 33/506
6,402,118 B1 * 6/2002 Nijsse et al. ..... 248/550
2002/0148147 A1 * 10/2002 Francis ..... 40/426
2003/0041490 A1 * 3/2003 Dott et al. ..... 40/410

* cited by examiner

*Primary Examiner*—Eugene Kim
*Assistant Examiner*—Urszula M Cegielnik
(74) *Attorney, Agent, or Firm*—Brian C. Trask

(57) ABSTRACT

A device typically adapted for association with an air diffuser of a ventilation system of a dwelling. The device redirects an air stream from a forced air column received through the diffuser. A novelty item is disposed to depend from structure associated with the base for rotation of the novelty item by the air stream. An operable suspension system includes a magnet assembly and a magnetically attracted bearing element. Desirably, a safety catch is included to maintain the novelty item in proximity to the base in the event of decoupling between the magnet assembly and the bearing element. One preferred base is adapted to form a slip-on fit to a diffuser register of a dwelling's ventilation system. Certain novelty items are sized to provide a self-packaging capability for commercial display. An alternative base is structured to look like furniture, and may include a plurality of internal passageways through which air may selectively be directed. Certain bases may contain a scent source to impart a fragrance to the air discharged therefrom.

2 Claims, 6 Drawing Sheets

AIR-DRIVEN NOVELTY ITEM

RELATED APPLICATIONS

This application claims the benefit under 35 U.S.C. 119(e) of the filing date of Provisional Patent Application Ser. No. 60/500,752, filed Sep. 5, 2003, for "Air driven novelty item".

BACKGROUND

1. Field of the Invention

The present invention relates to structures adapted to cause motion in an object to promote visual interest toward that object in an observer. The invention is particularly directed toward structures and object suspension systems adapted to cause motion in a device under the impetus of a forced air stream. Certain preferred embodiments are directed to apparatus that are operated by air transported in forced air heating and/or cooling systems of the type typically installed in dwellings.

2. State of the Art

Commercially available forced air heating and/or cooling systems typically move a stream of air to a plurality of air diffusers to introduce warm or cool air into a dwelling at distributed locations. Such diffusers typically are disposed on the floor at one or more locations around the perimeter of rooms within the dwelling. In certain cases, such as may be found in dwellings with older construction, diffusers may alternatively be disposed on lower portions of certain walls. Diffusers can also be located in ceilings.

In some cases, the location of one or more air diffusers may conflict with a desired arrangement of a room's furnishings. For example, the discharge air stream from an air diffuser disposed in a corner of a floor may substantially be blocked by a desired furniture grouping. The furniture may interfere with a flow of air from the diffuser, resulting in a decrease in heating or cooling efficiency and efficacy.

Air deflectors are commercially available as add-on components; typically being adapted for positioning over a floor diffuser and shaped to direct air towards the center of a room. Such diffuser add-ons may be formed from a clear plastic to decrease their unsightly visual impact. Deflectors of this type may inadvertently be moved from an operable position by a passersby who trip over them. Other causes of mispositioning such deflectors include cleaning, such as vacuuming or mopping, which can dislodge the deflector. Furthermore, the functionality of such deflectors may be compromised by placement of furniture which obstructs the deflector opening, or otherwise interrupts the discharged air stream.

It would be an improvement to provide an add-on air diffuser which may present the pleasing and functional appearance of furniture, and provide an enhanced air path for warm or cool air from the original air diffuser. An additional improvement would optionally scent the discharged air stream. It would also be an improvement to provide a diffuser which can subtly indicate the presence of a discharge air stream. Certain improved diffusers desirably could be arranged to provide variable amounts of air power to drive a flow-indicating curio suspended on a low-friction mounting arrangement. A desirable such curio may use rotation to attract attention, as for use in advertising. A still further improvement would provide an air-driven novelty item having constituent structure operable as a portion of a display package for commercial sale of the novelty item.

BRIEF SUMMARY OF THE INVENTION

The present invention provides an apparatus adapted to receive a motion-inducing input from a forced-air column. The apparatus includes a base configured and arranged for disposition in the path of said forced-air column. Usually, the forced-air column is obtained from a ventilation system of a dwelling. The base carries an air nozzle operable to direct a discharged air stream portion of the forced-air column. Typically, a novelty item is disposed for rotation about a low-friction support and associated with an impeller system adapted to cause rotation responsive to the discharged air stream.

Usually, a base provides a cover adapted to interface with an air diffuser component of a ventilation system of a dwelling. However, an air stream input for a base may be obtained from other sources, such as from a fan. One workable base includes a blocking foundation adapted to interface with an air diffuser of a ventilation system. The blocking foundation interferes with at least a portion of the air column discharged from the diffuser. A desirable interface between the base and diffuser includes structure adapted to form a slip-on fit, in which a portion of the diffuser is captured in engagement between the blocking foundation and feet associated with the blocking foundation. An alternative base includes a cabinet having an exterior with the visual appearance of furniture.

In most cases, rotation of the novelty item is about a vertically oriented axis. Desirably, the air nozzle is vectorable to provide control over a direction of a discharged air stream therethrough. An impeller, or fan blade system, is associated with the novelty item and is disposed in the discharged air stream. Therefore, vector control of a nozzle permits control of the rotational speed, and/or the direction of rotation of the novelty item.

One operable low-friction support includes a source of magnetic energy and a coupling structure attracted to the magnetic source. An operable coupling structure includes a magnetically attracted material spaced apart from the source of magnetic energy by bearing structure adapted to form a substantially point contact with the magnetic source. A currently preferred bearing structure includes a pointed end of a ferrous metallic element. It has been determined that a rare earth permanent magnet is a good source of magnetic energy.

In some cases, it is preferred to include an adjustable counterweight system operable substantially to match the weight of a suspended novelty item to a suspending force generated between the source of magnetic energy and the coupling structure. It can be advantageous to include a safety catch mechanism operable to maintain the novelty item in a captured relationship with the base in the event of a decoupling between the novelty item and the low friction support.

A currently preferred novelty item includes structure having self-packaging capability and defining a volume operable in which substantially to contain the base and nozzle for commercial display of the apparatus. A cylindrical canister sized to contain the base and nozzle, and operable to display indicia on a portion of its exterior, is one example of such a self-packaging novelty item.

A currently preferred embodiment of the invention is adapted to receive a motion-inducing input from a forced-air column obtained from a ventilation system of a dwelling. Such embodiment includes a base adapted to couple with an air diffuser component of the ventilation system operably to dispose a blocking foundation in the path of the forced-air column. An air nozzle is associated with the blocking foundation and operable to direct a discharged air stream portion of the forced-air column. A preferred interface between the base and diffuser comprises a slip-on fit in which a portion of the diffuser is captured in engagement between the blocking foundation and feet associated with the blocking foundation.

This preferred embodiment also includes a novelty item disposed for rotation about a vertically oriented axis depending from a low-friction support comprising a source of magnetic energy and a coupling structure attracted to the magnetic source, with the novelty item being structurally associated with an impeller system adapted to receive the discharged air stream to effect its rotation. Desirably, an adjustable counterweight system is also provided and operable substantially to match the weight of a suspended novelty item to a suspending force generated between the source of magnetic energy and the coupling structure. In general, a safety catch mechanism is also included. Such safety catch is operable to maintain the novelty item in a captured relationship with the base in the event of a decoupling between the novelty item and the low friction support.

An alternative embodiment of the invention is adapted for disposition in association with an outlet of a forced-air ventilation system in a dwelling and operable to redirect a forced-air column received through the outlet. The decorative diffuser provides the visual appearance of furniture and includes structure defining a plurality of selectable pathways disposed internal to the diffuser and operable in which to transport a portion of the forced air column. A control mechanism is included, and operable to direct flow of a portion of the forced-air column through a selected pathway. Desirably, a novelty item is disposed at an output location of the diffuser and operable to indicate the presence of a forced-air output. Sometimes, a scent source may be included and disposed in an internal or external pathway.

BRIEF DESCRIPTION OF THE DRAWINGS

In the drawings, which illustrate what are currently considered to be the best modes for carrying out the invention.

DETAILED DESCRIPTION OF THE ILLUSTRATED EMBODIMENTS

Figure 1:
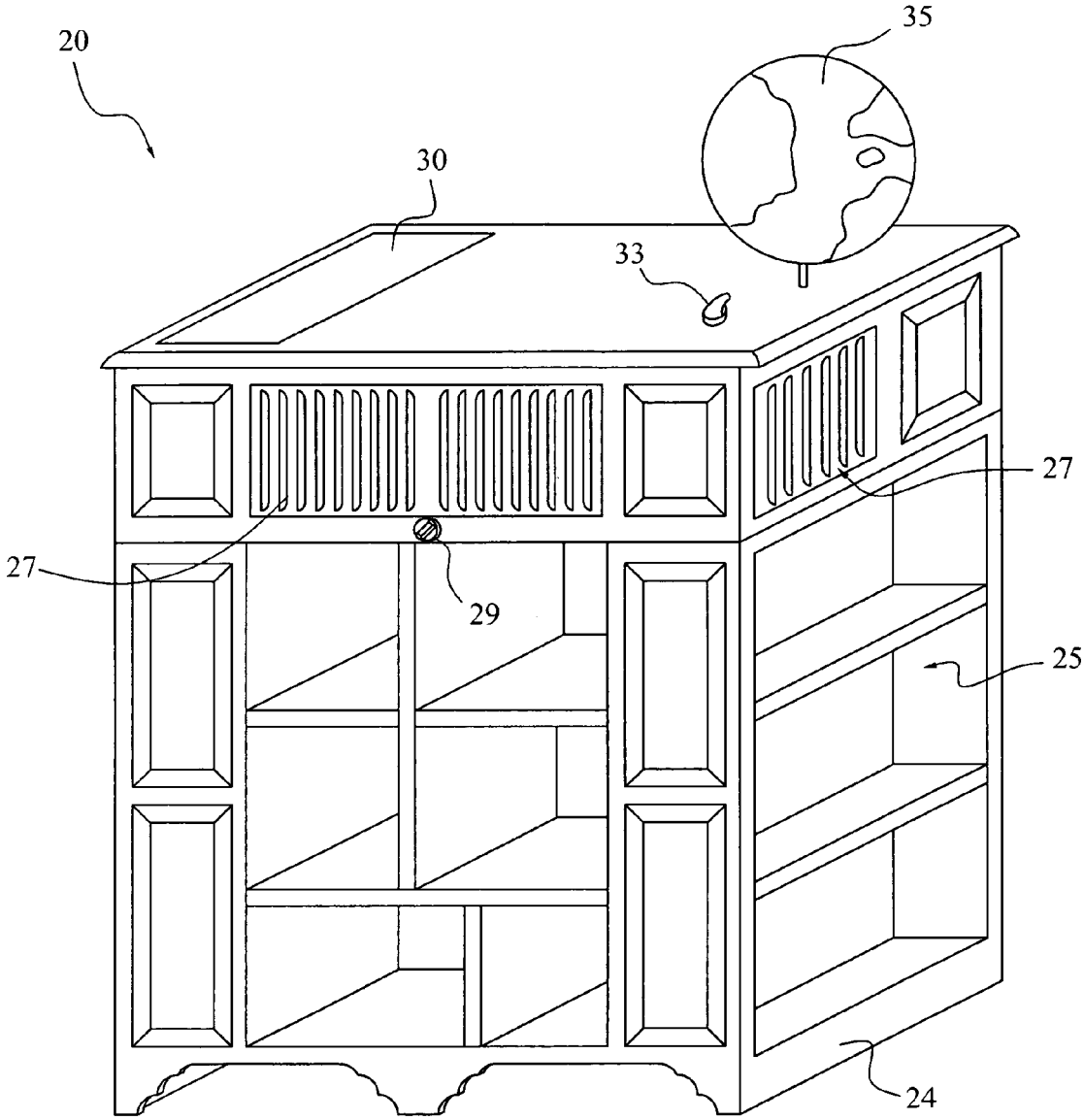
FIG. 1 is a front view in perspective of one currently preferred embodiment of the invention.

A first device constructed according to principles of the invention is illustrated in FIG. 1, and generally indicated at 20. Device 20 includes a base cabinet 24 adapted to receive an input from a floor or wall diffuser of a forced-air ventilation system of a dwelling. Devices 20 typically incorporate a utilitarian disguise, such as curio display cabinet 24 or a bookshelf, to assist in drawing attention away from the air diffuser function. The furniture base 24 transfers air flow from an air diffuser located on a floor or wall area to one or more elevated and unobstructed locations for discharge into a room.

The curio display area, generally indicated at 25, or bookshelves is structured to enclose air ducting internal to the body of cabinet 24 and arranged to redirect the received air column input. The device 20 is operable to redirect air from a location proscribed by a dwelling's built-in air diffuser, to a more optimized diffuser location, such as through one or more diffusers 27. The optimized location(s) can promote better air circulation through a room in which the device 20 is installed.

One or more controls 29 may be provided to select a path of the air discharged from device 20. As illustrated in FIG. 1, one or more air vent grills 27 may be disposed at various locations on the body of the cabinet. Provision may be made to adjust an opening of each such grill vent 27 to control the amount of air flowing from the cabinet 24 into the room. Examples of workable air flow control apparatus include adjusting a size of opening by a slidable door positioned over the grill, closing a damper behind the grill opening, or through use of other conventional flow control mechanisms. Access to an interior of one or more internal air passageways may also be provided, e.g. through access door 30.

Figure 2:
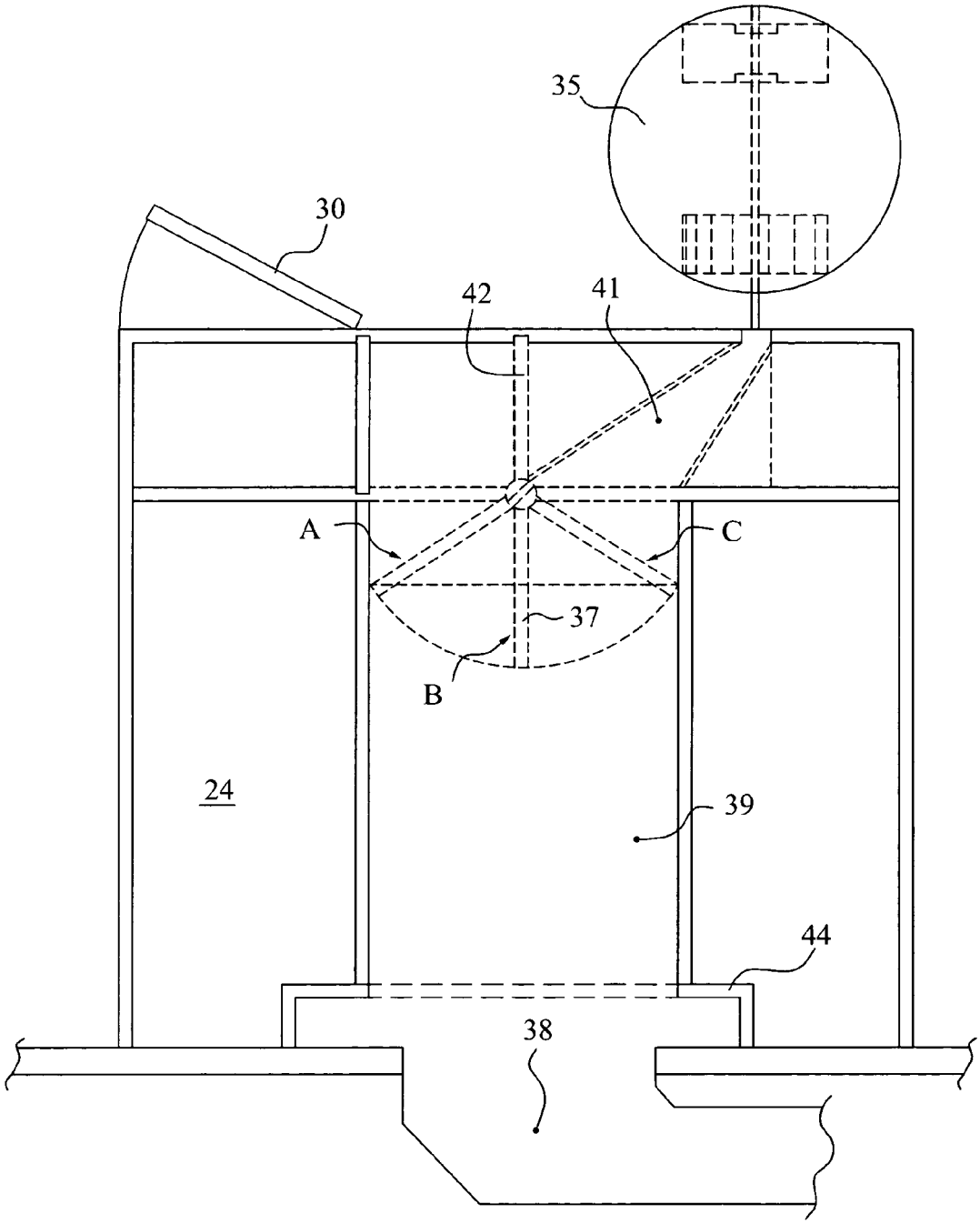
FIG. 2 is a front view in elevation detailing a control mechanism of FIG. 1.
Figure 3:
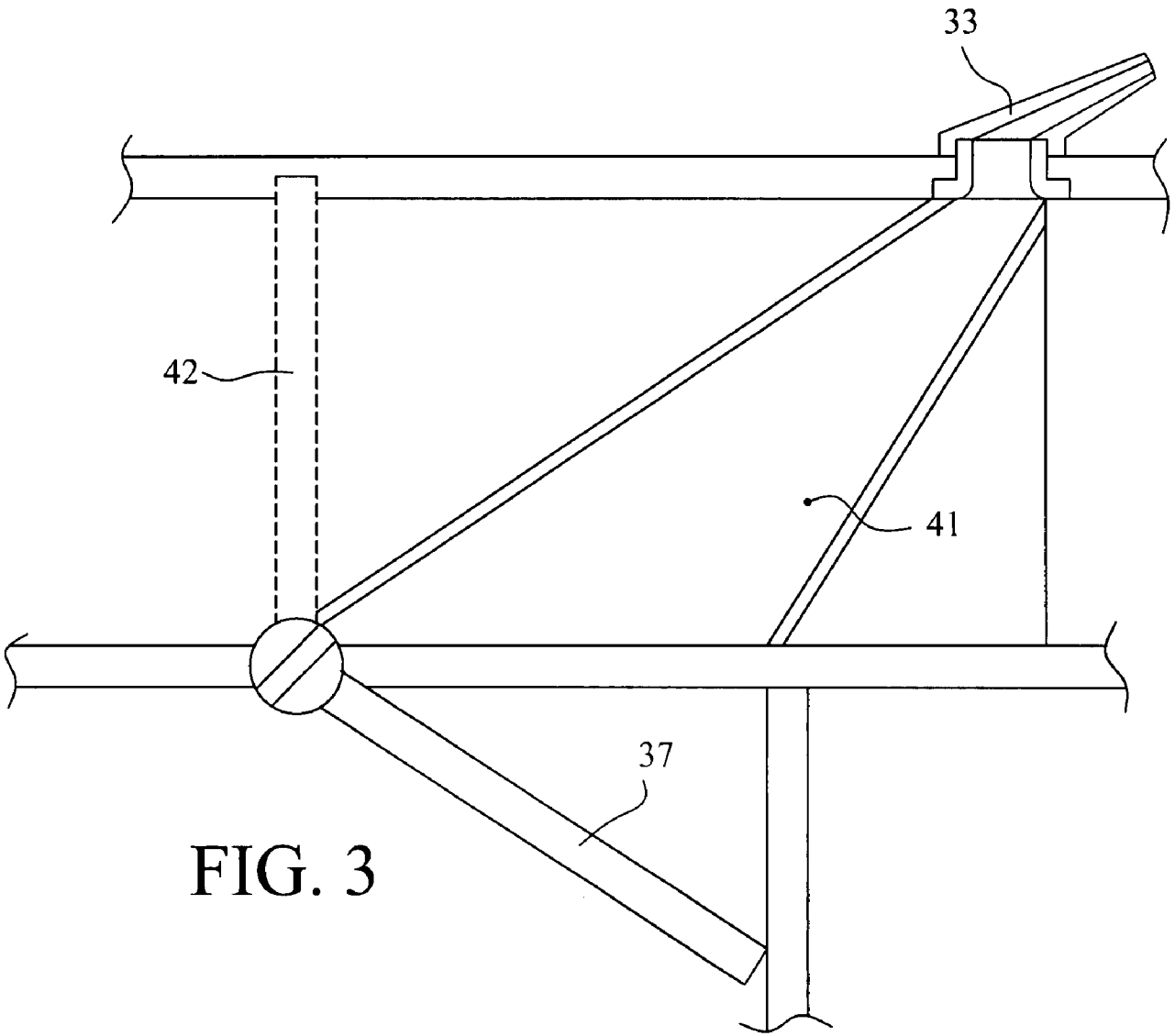
FIG. 3 is a front view in elevation and in section of one embodiment of a vectorable air nozzle.

Air may also be discharged, if desired, from a nozzle 33 to impinge on an air flow indicator, or novelty item such as the illustrated globe 35. Rotation of the globe 35 may then serve as a subtle indication of air flow from the cabinet 24. Air flow may be divided between the various cabinet discharge locations 27, 33 by an internal valve arrangement including damper 37, which may be adjusted by the illustrated control knob 29. As illustrated in FIGS. 2 and 3, damper 37 may be positioned to divert all, or a portion of the air column received by cabinet 24 from the ventilation system ducting 38. At position 'A' in FIG. 2, all of the air column in internal passageway 39 is directed toward the nozzle 33 through collector ducting 41. Internal air passageways may be formed by a plurality of divider walls, such as divider 42. In some cases, trapping structure 44 is provided to seal an opening between the air duct and the cabinet 24, to resist undesired leaks of the forced air column. The body of cabinet 24 may include pocket doors to control air flow through the grills as one air flow control mechanism.

Figure 4:
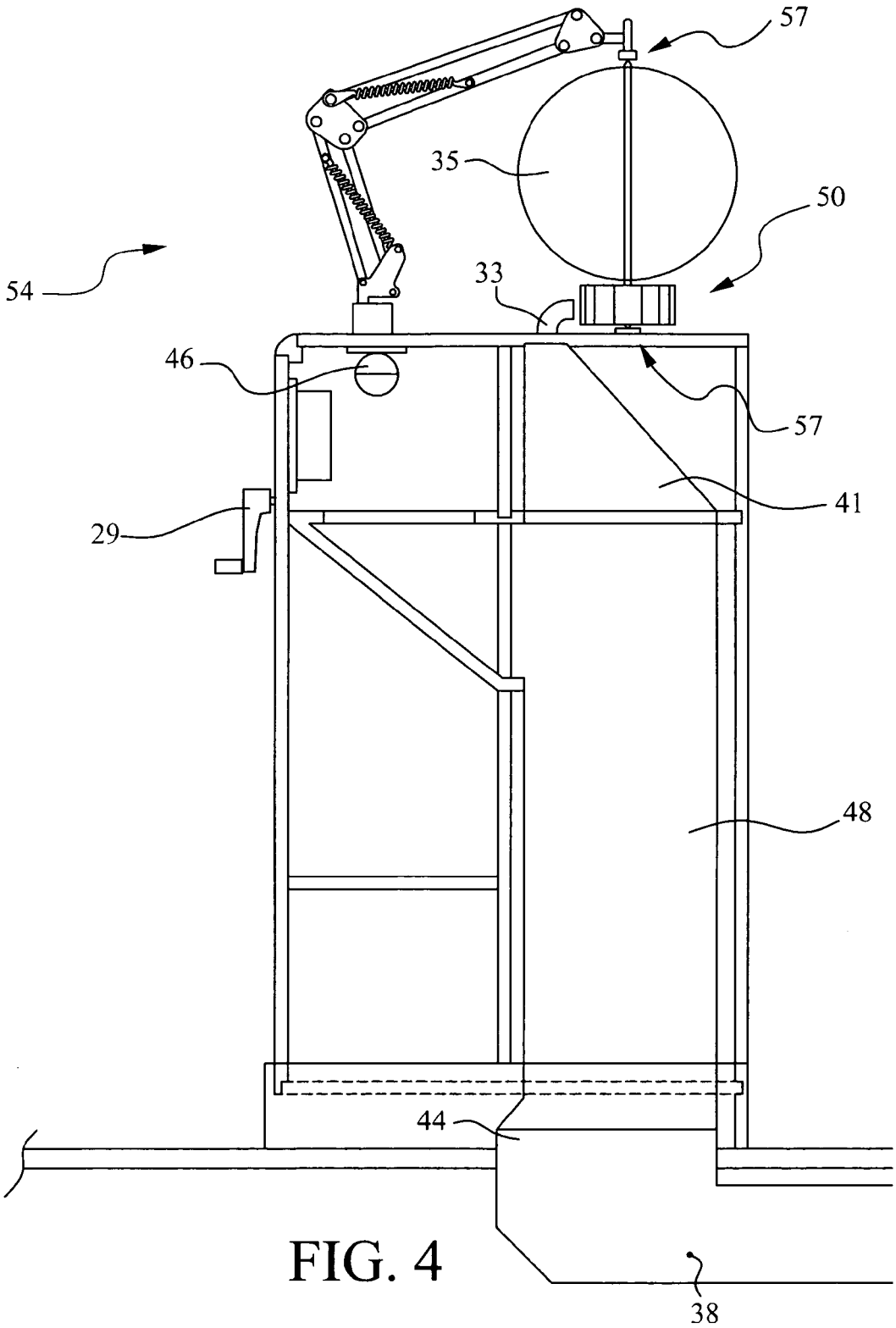
FIG. 4 is a side view in section of an alternative base cabinet and support system for an air-driven novelty item.

It is within contemplation to optionally release fragrance into the air discharged from a cabinet 24. A rotating drum containing the scented substance may be located in an air flow path internal to the cabinet 24. Rotation of the drum by the airstream may help to release the scent. With reference to FIG. 4, a container 46 of a fragrance bearing substance, such as spices, pot-pori, or rose petals and the like, may be similarly positioned in an air stream. Container 46 may, or may not, be adapted to move under influence of the internal airflow. When the scent is not desired, the container may be moved from the air stream to a storage position in the cabinet body, but out of the airflow. An access door 30 (see FIG. 1) may be provided to facilitate positioning of the scent container between active and inactive locations. It is currently felt that an improved release of scent may be obtained by stirring the contents of the fragrance bearing container.

Air may be introduced into the cabinet body from either a forced air floor vent, or wall vent. With reference now to FIGS. 2 and 4, a vent duct adapter 44 may be provided to sealingly interface with a forced air floor duct 38. Alternatively, a rear panel may be removed from the cabinet to interface the adapter with a wall mounted duct opening. Air flowing though the interior of the cabinet may be confined inside flexible ducting 48, or in leak resistant passages formed by cabinet structure. It is within contemplation that the cabinet may be structured for air-sealing interface with either a wall or floor area in proximity to a built-in vent. Simply placing the cabinet over (or in front of) a vent thereby captures the discharge of a built-in diffuser for distribution into a room through certain embodiments of the invention.

Figure 5:
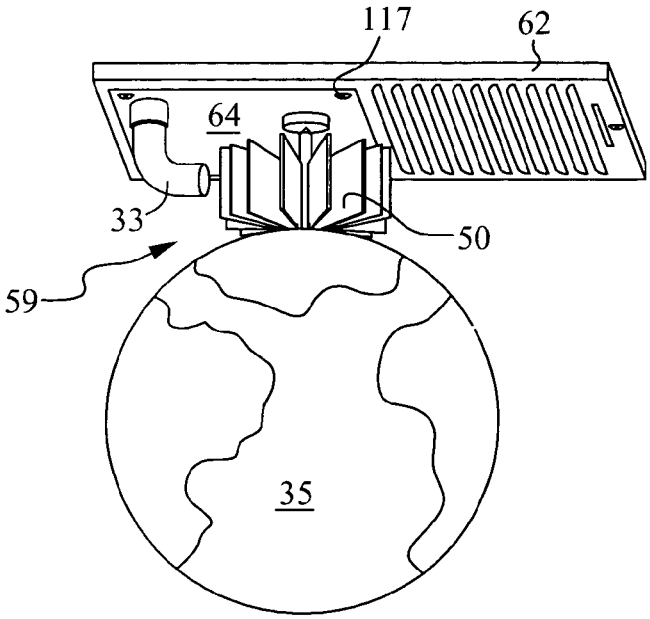
FIG. 5 is a view in perspective of one currently preferred mounting arrangement for an air-driven novelty item.
Figure 6:
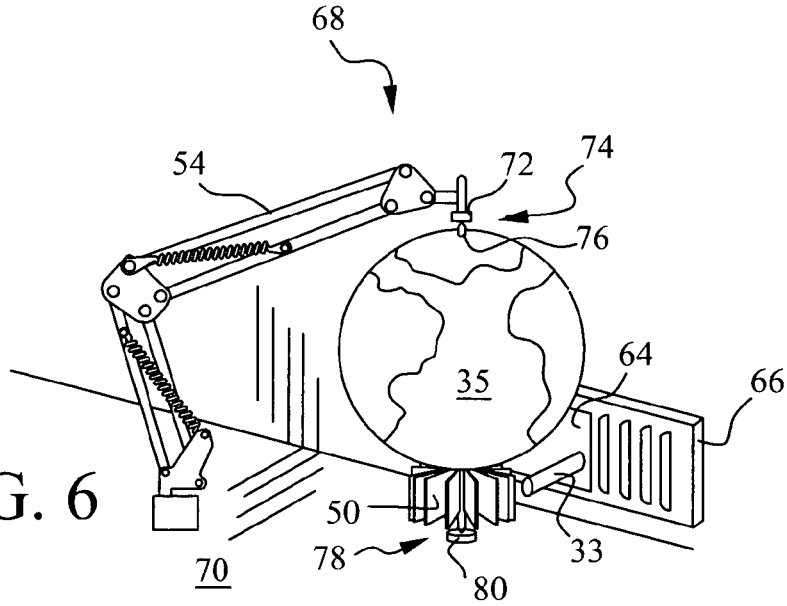
FIG. 6 is a view in perspective of an alternative mounting arrangement for an air-driven novelty item.

FIGS. 4 through 6 illustrate details of construction of arrangements operable to provide a rotating novelty configured as an air flow indicator. A simple air flow indicator might merely be a piece of paper disposed in the path of air from a diffuser, and which may flutter to indicate flow of air. However, the invention can be embodied to provide a more subtle and sophisticated air flow indicator. The air flow indicator may be a globe 35, as illustrated, or other moving mechanism or component. The air flow from an air discharge nozzle 33 may be used as a power source to operate a motion indicating device of some sort. In the case of the illustrated globe 33, air impinging on the fan blades 50, which can be internal or external to the globe 33, cause globe rotation. Alternate indicating devices within contemplation include a train or other vehicle having wheels which rotate in the presence of a discharge air stream.

FIG. 4 illustrates an alternative cabinet 52 configured as a base support for a rotating globe novelty item. The cabinet 52 can direct air from a floor vent 38 (as illustrated), or from a wall-mounted vent to provide a power source to operate the globe 35 or other moving novelty item. A spice ball 46 can be placed into the air stream to scent the discharged air. A hanging support arrangement for the globe 35 is provided by the spring-biased cantilever arm 54. It has been found that certain novelty items, such as the illustrated globe, may operate best if suspended from a magnetic bearing arrangement 57. In some cases, a plurality of bearing arrangements 57 may be provided to resist wobble of the novelty item 35.

As illustrated in FIG. 5, the invention can be embodied to include a rotating curio 35 that is suspended by a suspension mechanism, generally 59, which provides very low rotational friction. A nozzle 33 directs air from a HVAC system vent 62 to impinge upon vanes 50 causing curio 35 to rotate. Nozzle 33 can be carried on base structure 64 operable at least partially to block flow of air from vent 62. Base structure 64 may be affixed to register 62 using any convenient coupling arrangement. The curio 35 can be directly suspended from a ceiling vent register 62, as illustrated in FIG. 5, or held by other structure (e.g. cantilevered arm 54) for operation by a wall vent 64 or floor vent. In any suspension arrangement, a discharge direction of the nozzle 33 desirably is adjustable to reverse direction of rotation of the curio, and to control its rotational speed.

As illustrated in FIG. 6, one operable suspension mechanism 68 (holding a novelty item 35 above surface 70 by crane arm 54) positions a first magnet 72 capable of holding the weight of all structure associated with the curio 35. A top pointed end 74 of axle 76 contacts magnet 72. A bottom pointed end 78 of axle 76 interfaces with magnet 80 (which can be fixed to surface 70) to resist wobble of the bottom portion of the curio 35 as air flow through nozzle 33 increases or decreases. Typically, a small gap (e.g. 1/32 inch) is left between bottom end 78 of axle 76 and magnet 80.

An air-powered curio within contemplation can be a globe 35, as illustrated. Curios, or air-powered novelty items operable in the invention, can be of any shape, including spherical and cubic. Alternative visible surface decorations of the curio can include: advertising slogans, sports insignia or emblems, light emitting apertures, or faceted reflective surfaces. It is also within contemplation to provide a cabinet base for a nozzle having an alternative source of air flow, such as an internal fan.

Figure 7:
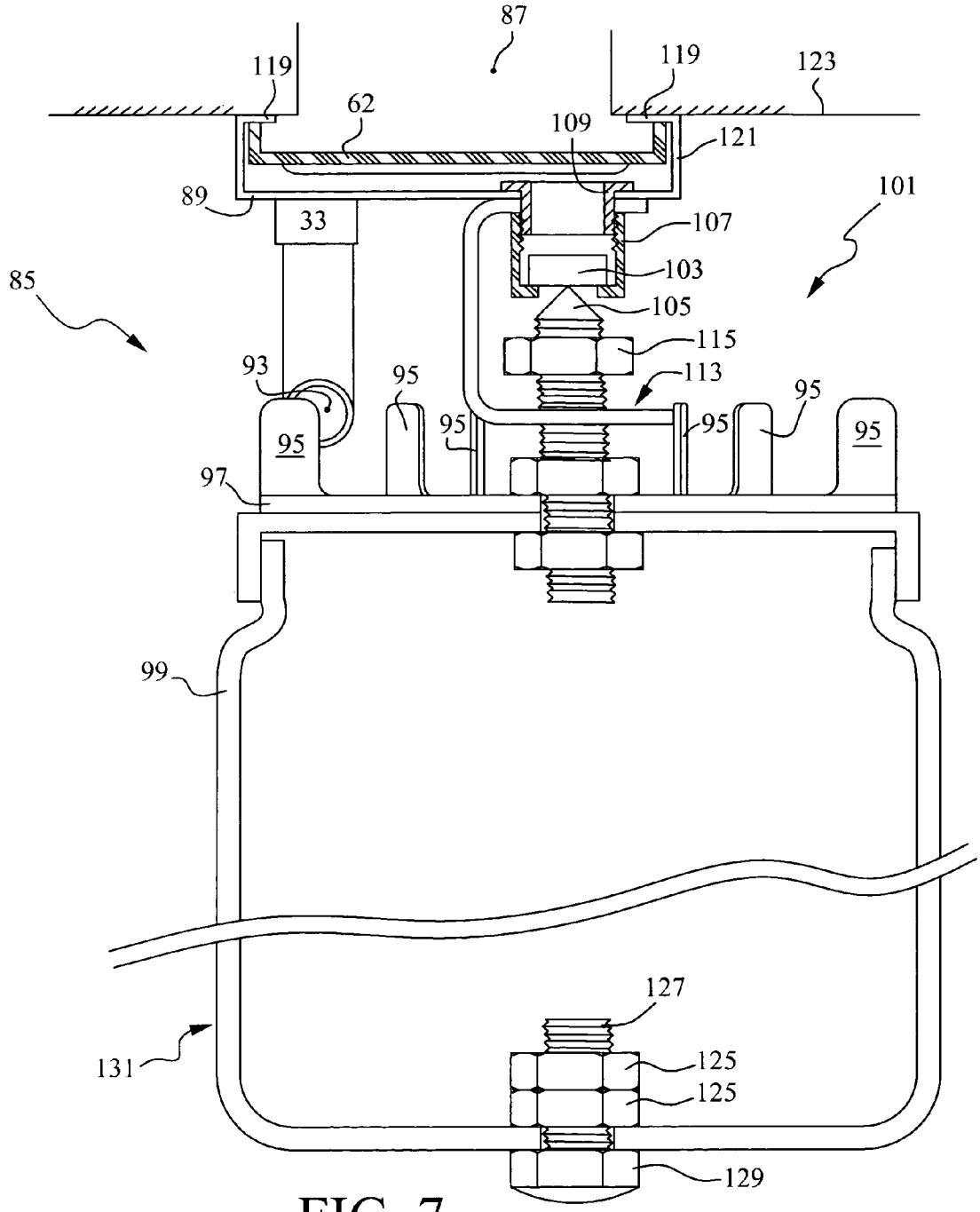
FIG. 7 is a front view, partially in section, of a currently preferred embodiment of the invention.

A currently preferred embodiment of one aspect of the invention is indicated generally at 85 in FIG. 7. Embodiment 85 is adapted for rotation of an air-driven curio by an air column discharged from a ceiling duct 87 of an HVAC system. A base 89 is adapted to dispose a blocking portion 91 in a position to impede at least a portion of the air column received through register 62 from duct 87. Base 89 carries a nozzle 33 that desirably is vectorable to change a direction of an airstream discharged from orifice 93. Nozzle 33 places orifice 93 into fluid communication with an obstructed portion of the air column in duct 87. The airstream discharged through orifice 93 can be guided to impinge upon blades 95 of fan, or impeller 97. A novelty item, such as illustrated canister 99, is coupled to impeller 97 operably to rotate under the influence of the discharged airstream.

The currently preferred suspension system, generally indicated at 101, includes a magnetic source, such as one or more magnet 103, and a bearing element 105 that is attracted to the magnet 103. An operable magnet 103 includes a rare-earth magnet made from material such as Neodymium. One magnet operable in the invention includes part No. ND 103-35, available from Sign Service, having a place of business located at 3370 West 500 South, Salt Lake City, Utah 84106. It is currently preferred to couple a pair, or more, of such magnets in series to form a more powerful magnetic source. As illustrated, magnet 103 may be associated with base 89 by an open-bottomed, internally threaded, cylindrical housing 107 engaged with threaded grommet 109. Other coupling arrangements are also operable.

Bearing element 105 may include a pointed end, as illustrated, adapted to reduce friction at its contacting interface with magnet 103. One operable bearing element 105 is formed from a section of ferrous all-thread that is ground to a point and hardened. High carbon steel bolts may also be similarly pointed and hardened, and operate as excellent alternative bearing elements.

A safety catch mechanism 111 may conveniently be captured between grommet 109 and housing 107. Safety catch mechanism 111 is operable to maintain canister 99 in association with register 62 in the event that bearing element 105 is decoupled from engagement with magnet 103. Bearing element 105 is placed in engagement through an oversized hole 113 in safety catch 111, and nut 115 is threaded onto bearing rod 105. Oversize hole 113 is larger than a diameter of bearing element 105 to avoid making contact therebetween. The nut 115 is sized too large to pass through the hole 113, so canister 99 remains in association with register 62, even if canister 99 is significantly jostled and magnet 103 is uncoupled from bearing 105.

Base 89 may be affixed to register 62 in many ways, nonexclusively including by way of mechanical fasteners 117 (see FIG. 5), or with a currently preferred slide-on arrangement, such as illustrated in FIG. 7. A pair, or more, of feet 119 are spaced apart from blocking portion 91 by extension structure 121. Register 62 can be trapped in engagement between blocking portion 91 and feet 119. To install a base 89 onto register 62, the fastening hardware for register 62 is loosened to slightly separate register 62 from the ceiling 123. Feet 119 are placed between register 62 and ceiling 123, and the base 89 is slid axially into position to block at least a portion of register 62. The retaining hardware (not illustrated) for register 62 may then be retightened, as desired.

It is within contemplation alternatively to adapt blocking portion 91 to variably space apart feet 119 in a width direction, to accommodate registers 62 having different sizes, and to permit an alternative installation method. One way to accomplish such adjustability is to form blocking portion 91 to have overlapping sections disposed to slide relative to each other. Also, certain embodiments of base 89 may include one or more seals adapted to block end portions between blocking portion 91 and vent 62 operably to increase air pressure for discharge through a nozzle 33.

It is desirable to provide a weight adjustment capability in the suspended novelty. Preferably, the suspended weight is in close agreement to the capacity of the magnet 103, to reduce a friction load. As shown in FIG. 7, a plurality of nuts 125 may be disposed in engagement with axle 127. Weight can be added or subtracted as required for initial matching between weight of the novelty of the force of magnet 103, or to compensate for a reduction in magnetic force over time. In any event, it is desirable to provide a novelty that is at least reasonably in balance about an axis, to resist wobble during rotation. It should be noted that axle 127 could be embodied as a continuation of bearing element 105, rather than the stub axle arrangement illustrated. In any event, it is desirable to provide an exterior appearance to nut or bolt head 129 that is attractive. Sometimes, a carriage nut, or acorn nut, is provided to serve as a nut 129, and axle 127 may be a length of all-thread.

A currently preferred cylindrical canister 99 can function as a package in which to contain substantially all portions of the base 89 and attendant structures. Such canister 99 may then serve as self-packaging in which to display a novelty and suspension assembly for commercial sale. Cylindrical canister 99 may carry imprinted indicia on exterior surface 131. Alternatively, a sign or other covering having a form like a sheet that can be rolled about surface 131, may be affixed to surface 131. Such covering may protrude in one or both directions to extend above and/or below canister 99 when in position suspended from a register 62. Canister 99 may also operate as a foundation on which to carry structure having a 3-dimensional appearance.

While the invention has been described in particular with reference to certain illustrated embodiments, such is not intended to limit the scope of the invention. The present invention may be embodied in other specific forms without departing from its spirit or essential characteristics. The described embodiments are to be considered as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus adapted to receive a motion-inducing input from a forced-air column obtained from a discharge opening of a ventilation system of a dwelling, the apparatus comprising:

a base adapted to dispose a novelty item in the path of said forced-air column;

said novelty item being disposable for rotation with respect to said base and about a vertically oriented axis depending from a low-friction support comprising a source of magnetic energy and a coupling structure attracted to said magnetic source, said novelty item being associated with an impeller system adapted to receive said discharged air stream to effect said rotation;

an adjustable counterweight system operable substantially to match the weight of a suspended said novelty item to a suspending force generated between said source of magnetic energy and said coupling structure; and a safety catch mechanism operable to maintain said novelty item in a captured relationship with said base in the event of a decoupling between said novelty item and said low friction support.

2. The apparatus of claim 1, wherein:

an interface between said base and said diffuser comprises a portion of said base being captured in engagement between a diffuser support surface and a portion of said diffuser.

* * * * *